US009605513B1

(12) United States Patent
Vandigriff et al.

(10) Patent No.: US 9,605,513 B1
(45) Date of Patent: Mar. 28, 2017

(54) METHOD OF GAS, OIL AND MINERAL PRODUCTION USING A CLEAN PROCESSING SYSTEM AND METHOD

(71) Applicants: John Edward Vandigriff, Carrollton, TX (US); Einar Arvid Orbek, Jr., Las Vegas, NV (US)

(72) Inventors: John Edward Vandigriff, Carrollton, TX (US); Einar Arvid Orbek, Jr., Las Vegas, NV (US)

( * ) Notice: Subject to any disclaimer, the term of this patent is extended or adjusted under 35 U.S.C. 154(b) by 0 days.

(21) Appl. No.: 14/756,363

(22) Filed: Sep. 4, 2015

(51) Int. Cl.
*E21B 36/00* (2006.01)
*E21B 43/16* (2006.01)

(52) U.S. Cl.
CPC ..... *E21B 36/001* (2013.01); *E21B 43/164* (2013.01)

(58) Field of Classification Search
CPC .... E21B 36/001; E21B 43/164; E21B 43/162; E21B 43/16; E21B 43/24; E21B 43/2406; E21B 43/2408; E21B 43/2405; E21B 33/10; E21B 34/06; E21B 43/26; E21B 43/34; E21B 47/06
See application file for complete search history.

(56) References Cited

U.S. PATENT DOCUMENTS 3,439,744 A * 4/1969 Bradley ..... E21B 33/10 166/287
5,141,054 A * 8/1992 Alameddine ..... E21B 43/24 166/252.1
5,472,050 A * 12/1995 Rhoten ..... E21B 43/12 166/250.1

* cited by examiner

*Primary Examiner* — Wei Wang
(74) *Attorney, Agent, or Firm* — John E. Vandigriff

(57) ABSTRACT

The invention provides a system and process for providing a clean, non-contaminating process, for producing fracturing of shale, limestone, sands and other geological and mining formations to release natural gas, oil and minerals within a formation. A system used in the process produces on site the energy required to induce fracturing, removing natural gas and oil, and to recycle fluids used in fracturing for additional use. Removable storage provides the necessary materials to provide fracturing, removal and processing of the fracturing liquids for addition use at one or more sites, and to provide processing, storage and transportation of the resulting natural gas and oil.

5 Claims, 4 Drawing Sheets

METHOD OF GAS, OIL AND MINERAL PRODUCTION USING A CLEAN PROCESSING SYSTEM AND METHOD

This is a divisional application Ser. No. 14/121,591, filed Sep. 22, 2014.

FIELD OF THE INVENTION

The invention relates to a method and system for producing fracturing of shale and oil sands, and mineral containing material to release natural gases and oil utilizing $CO_2$ and a steam process without using other chemical contaminants.

BACKGROUND OF THE INVENTION

Most fracturing processes use various chemicals in their process to recover gas and oil. For example, U.S. Pat. No. 8,733,439 uses $CO_2$, but also used $H_2O_2$ (hydrogen peroxide) which, when used medically in small amounts, is considered a mild antiseptic, and can be used as a bleaching agent. Hydrogen peroxide can be used for certain industrial or environmental purposes as well, because it can provide the effects of bleaching without the potential damage of chlorine-based agents. Because this substance can be unstable in high concentrations, it must be used with care. In higher concentrations, it can create strong chemical reactions when it interacts with other agents, and it can damage the skin or eyes of persons working with it. The use in wells may contaminate underground water if there is seepage into ground water. This patent also uses other chemicals such as Fe, Co, Ni and similar chemicals.

Other processes also use various chemicals, particulate material, and other catalysts which can contaminate water sources such as wells and aquifers. These processes utilize a large amount of water which often is not or cannot be recycled because of the toxic chemicals contained therein.

SUMMARY OF THE INVENTION

An object of the invention is to provide a clean, non-contaminating process for producing fracturing of shale, limestone, sands, and other geological and mining formations to release natural gas and oil within a well, and to break up any mineral containing material.

Another object of the invention is to provide a system to produce on site the energy required to induce fracturing, removing natural gas and oil, and to recycle fluids used in fracturing for additional use.

Another object of the invention is to provide for movable storage of fracturing liquids for additional use at one or more sites.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
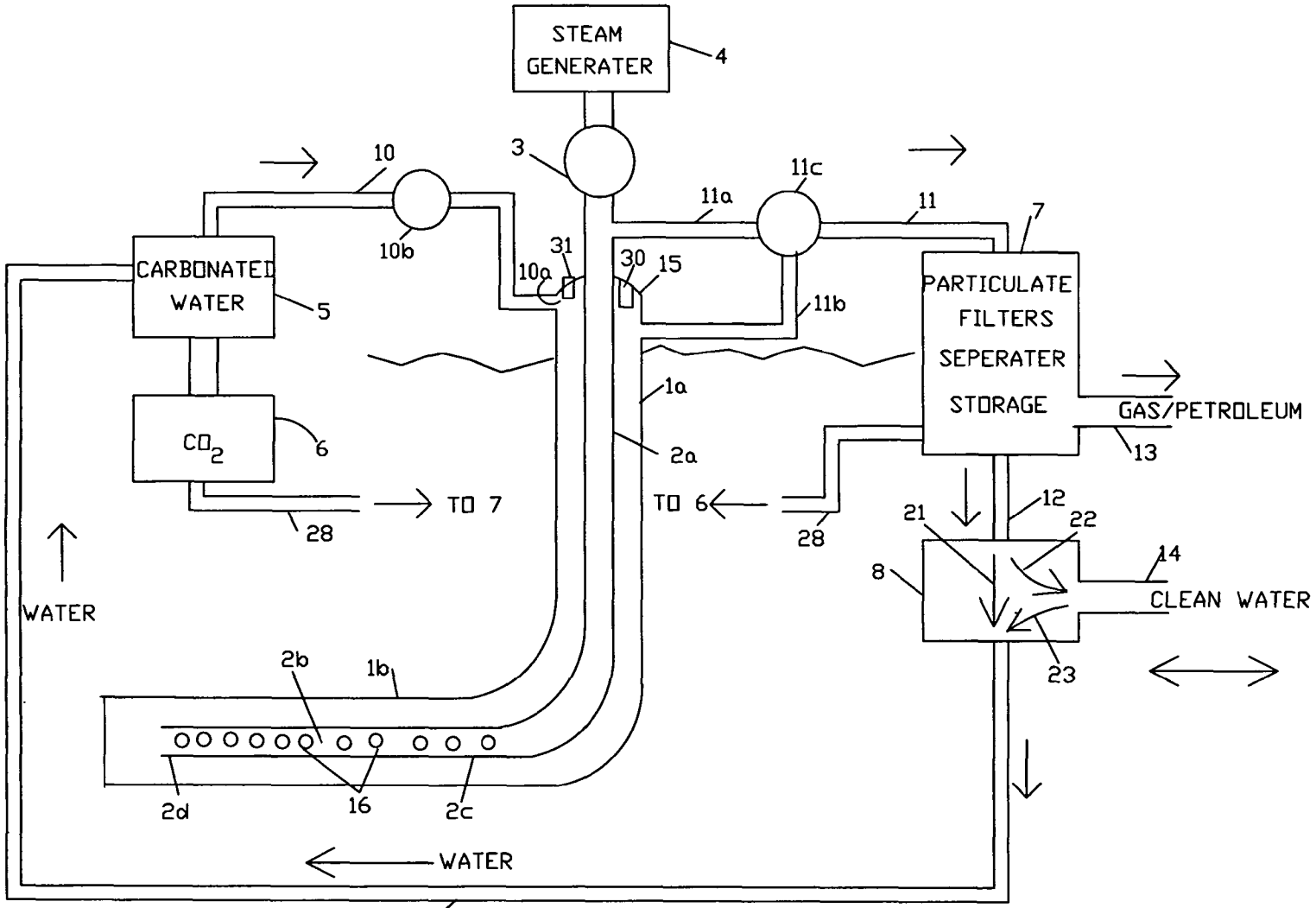
FIG. 1 illustrates a diagram of the basis system of the invention and the process associated therewith.

FIG. 1 illustrates the system and method for producing clean fracturing in a natural gas and oil well. The well has a vertical drill bore and or pipe casing 1*a* and a horizontal drill bore or pipe casing 1*b* extending horizontally from the lower end of vertical drill bore and or pipe casing 1*a*. This is the standard method of drilling wells. Inserted in the well is vertical pipe or tube 2*a* which extends the length of vertical well bore 1*a* and then extends horizontally, 2*b*, into the horizontal well bore 1*b*. Well bore 1*a* is then caped at the top with seal 15. This is to prevent any gasses or other material from escaping out into the atmosphere and surrounding area. This system is an example that can be used with the claimed fracturing process. Modification of the system and other configurations may be used with the fracturing process.

The rest of the system is described as follows. Clean water is supplied through input 14 through a processing system 8, which includes a three way valve. The water is directed through 23 into pipe and then in to storage container 5, which carbonates the water, using the $CO_2$ from portable storage container 6.

The carbonated water from container 5 is then directed, through pipe 10 and valve 10*b*, into the well at opening 10*a*. This carbonated water flows downward into the well and fills the horizontal portion 1*b* with carbonated water. The carbonated water in container 5 may be refrigerated to keep the carbonated water cool, or partially frozen so as to prevent vaporization of the $CO_2$ from the water while it is being injected into the well. The carbonated water may be lightly frozen to provide an icy slush. Sand can be injected into the wellbore alone, or with the carbonated water to aid in the fracturing process.

Once the well, particularly the horizontal portion 11*b* is filled with the carbonated water, then pressurized steam, generated in steam generator 4, is injected into the well though valve 3 into pipes or tubes 2*a* and 2*b*. Pipe/tube 2*b* has openings 16 around it periphery and along its length to distribute the steam throughout horizontal well bore 1*b*. The pressurized steam causes the carbonated water to literally explode creating a great pressure in the well causing fracturing of the walls of the well bore, thus releasing natural gas/oil from the underground sources. To keep all of the pressurized steam from exiting though the first holes at the beginning 2*c* of horizontal pipe 2*b*, there are fewer holes at the start of horizontal pipe 2*c* to prevent exiting of a large quantity of pressurized gas. The number of holes increases towards the 2*d* end of the horizontal pipe. This progressive increasing of holes helps to evenly distribute the pressurized gas throughout the horizontal portion 1*b* of the well.

After the fracturing process, the remaining carbonated water, any loose sand, and the gas/oil is then pumped upward though well bore 1*a* and pipe 2*a* through pipes 11*a* and 11*b* to valve 11*c* and though pipe 11 into processing unit 7, which may have storage capacity. Processing unit 7 filters out any particulate material and separates the gas/oil and $CO_2$ from the remaining water. The $CO_2$ can be returned through pipe 28 to the $CO_2$ storage tank 6 for reuse. The gas/oil is then stored or directed out pipe 13 for storage and/or transportation to another storage facility.

To prevent the particulate filter 7 from becoming clogged with particulate material, there could be at least two parallel particulate filters. One would be used at a time. When the flow of gas/petroleum/CO2 decreases to a lower determined level through the particulate filter, a sensor would detect this lower level and would switch the flow through a parallel filter. There would be a notification of this change, and the clogged filter could be cleaned to remove the particulate for use again.

The separated water is then passed through pipe 12 into processing system 8. The water can be directed back into the system though valve 21 for reuse, as needed, for additional fracturing of the well. The water can also be processed to clean it, removing any and all chemical and/or foreign matter from the well and then sent thought pipe 14 for storage and/or another use.

All of the units, Steam generator 4, carbonated water unit 5, $CO_2$ unit 6, separator 7 and processing system may all be portable units for use at other locations. The units may be incorporated in one movable unit for movement to other drilling sites.

To prevent excess pressure that would cause over fracturing in the well, a pressure sensor 30 measures the pressure. If the pressure exceeds a predetermined amount, then release valve 31 would open, and stay open, as long as the pressure exceeds the predetermined amount. When the pressure is reduced, then value 31 would close.

As an alternative to using carbonated water, refrigerated $CO_2$ can be injected into the well bore and then expanded with the pressurized steam. This would limit the amount of carbonated water needed in the well bore. Since steam is vaporized water, after the steam is injected into the refrigerated $CO_2$, it would cool and become carbonated water. Additional steam injected into the refrigerated $CO_2$ would cause it to expand and cause fracturing. This would limit the amount of carbonated water to be removed from the well for cleaning and future use.

Figure 2:
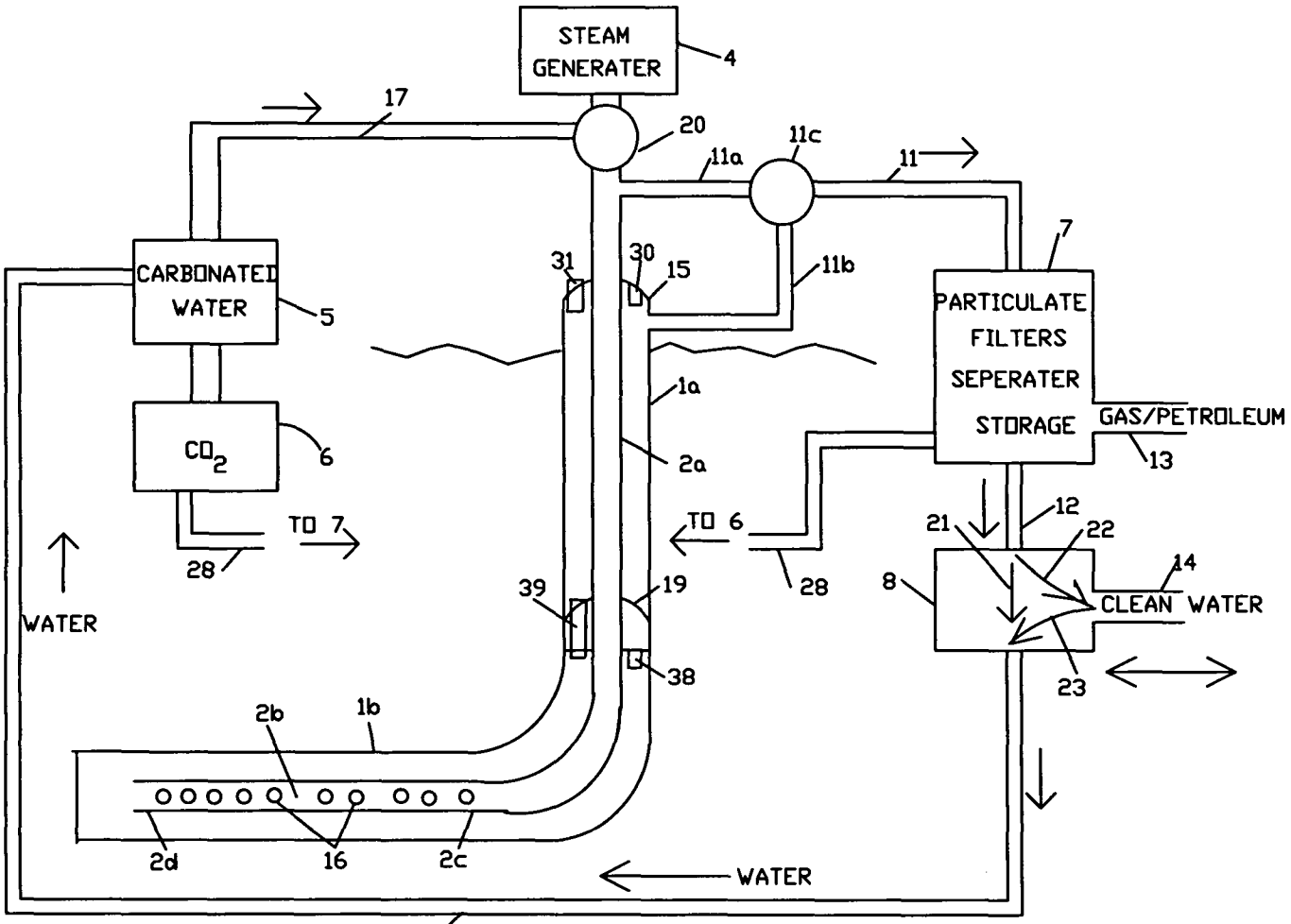
FIG. 2 illustrates additional features which may be utilized with the present invention.

FIG. 2 illustrates the system and method for producing clean fracturing in a natural gas and oil well as in FIG. 1 with the following differences in the system and method. In the vertical part of the wellbore 1*a*, a isolation plug 19 is placed near the bottom of the vertical portion 1*a* of the well bore, or in any part of horizontal well bore 1*b*. The location of the isolation plug is determined where the fracturing of the well is to begin. Since carbonated water cannot be inserted into the well after the isolation plug seal 19 is in place, the valve 3 of FIG. 1 is replaced with valve 20. The carbonated water is then passed through pipe 17 into valve 20 into pipe 2*a* to insert the carbonated water into the well bore. The carbonated water will flow downward through pipe 2*a* and horizontal pipe 2*b* and into the well out openings 16 and out the end 2*d* of horizontal pipe 2*b* into the well bore. The pressurized steam from steam generator 4 is directed through valve 20 into pipe 2*a* and 2*b*. The steam is then evenly distributed into horizontal well bore 1*b* through openings 16, as in FIG. 1, providing pressure to producing the fracturing required to release the natural gas or oil from the surrounding areas. The advantage of using isolation plug 19 is that the pressure cannot pass upward into vertical well bore 1*a*, or unwanted areas of 1*b*, providing a greater pressure in the localized horizontal portion of 1*b* of the well bore, increasing the fracturing pressure and increasing the result of the fracturing, releasing more natural gas and/or oil.

Isolation plug 19 could include a pressure sensor 38 and release valve 39 to prevent the pressure from exceeding a predetermined amount, to prevent over fracturing. The isolation plug can be later removed or drilled out to allow flow in well bore 1*a*.

After the fracturing process, the remaining carbonated water, any loose sand or other particulate material, and the gas/oil may be pumped upward though pipe 2*a* and well bore 1*a* through pipes 11*a* and 11*b* to valve 11*c*, and then through pipe 11 into processing unit 7.

Figure 3:
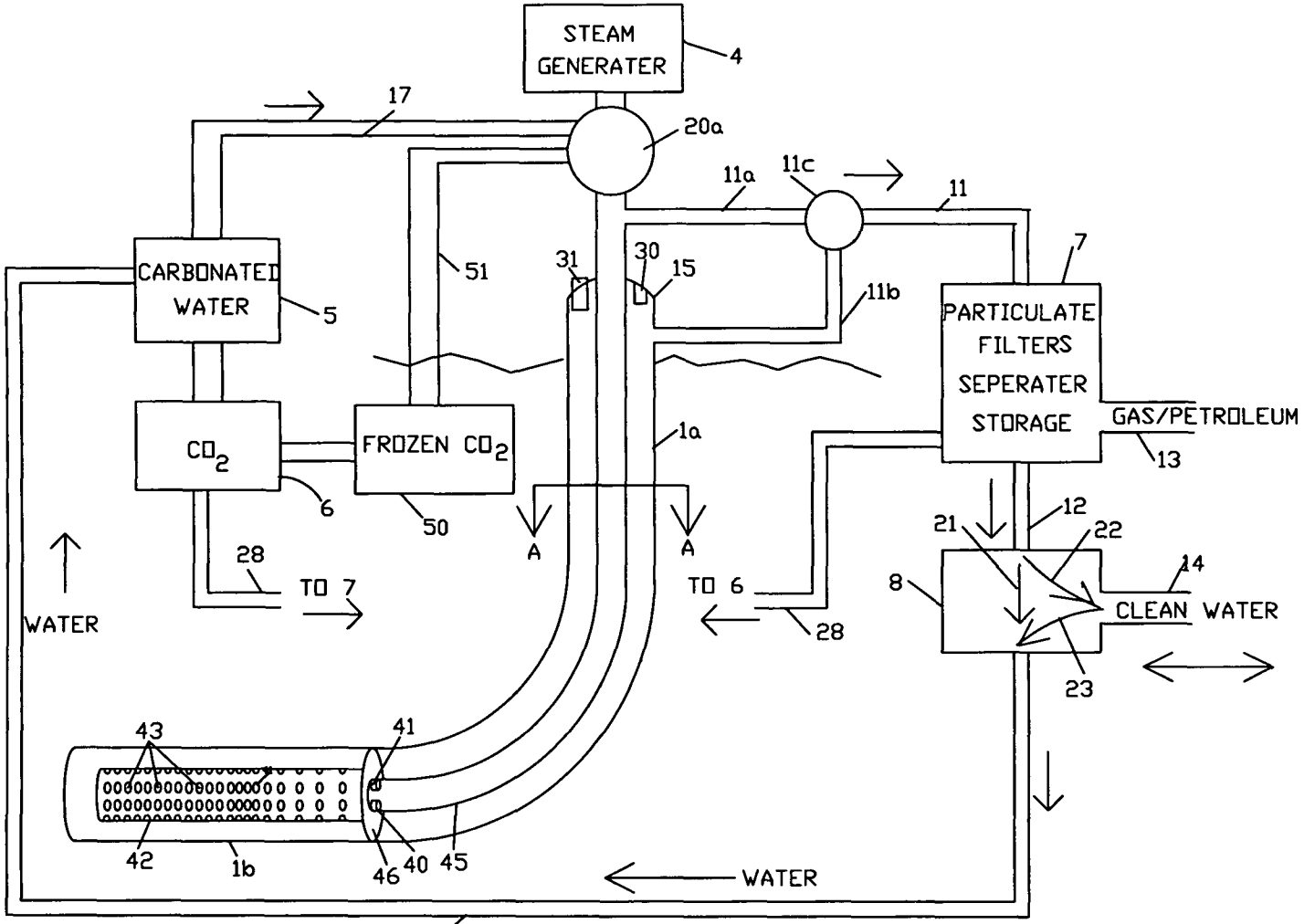
FIG. 3 illustrates a well configuration in which frozen $CO_2$ is inserted into a well and then expanded by pressurized steam to cause fracturing of the walls of the well.

FIG. 3 illustrates a well configuration in which frozen CO2 is inserted into a pipe 45 and then expanded by pressurized steam to cause fracturing of the walls of the well bore 1*b*. This configuration involves cooling CO2 in unit 50 to below its freezing temperature of 109.3 degrees F. and injecting a snow like compound into well bore 1*b*. This is achieved through a flexible composite material or metal alloy insertion hose or tube 51 and 45, which can be the same as tube 2*a*, FIG. 2, attached via a delivery hose or tubing from the surface. The cooled CO2 is released into the well bore through the perforations 43 in the insertion tube 42, or by use of, or with a perforating gun. When sufficient amounts of cooled CO2 are achieved, a CO2 sensor and release valve 41 immediately closes off the CO2 induction and triggers a steam pressure sensor and release valve 40 for high pressure steam to immediately be injected through the same insertion tube 42. A pressure containment plate 46 seals the lower portion of the well to prevent pressure from rising upward to the top of the well. This process creates a catalytic reaction that rapidly heats and expands the cooled CO2 causing the fracturing of the shale or other geological formation being addressed. This process can be carried out in one large stage or in multiple stages, depending upon the specific characteristics of the geological formation being fractured, and can be repeated until the required desire of fracturing is achieved. This configuration can be used in combination with the basic system shown in FIG. 2 where the assembly in FIG. 3 replaces the structure at the lower end of tube 2*a*, or any part of horizontal 1*b* of FIG. 2.

Figure 4B:
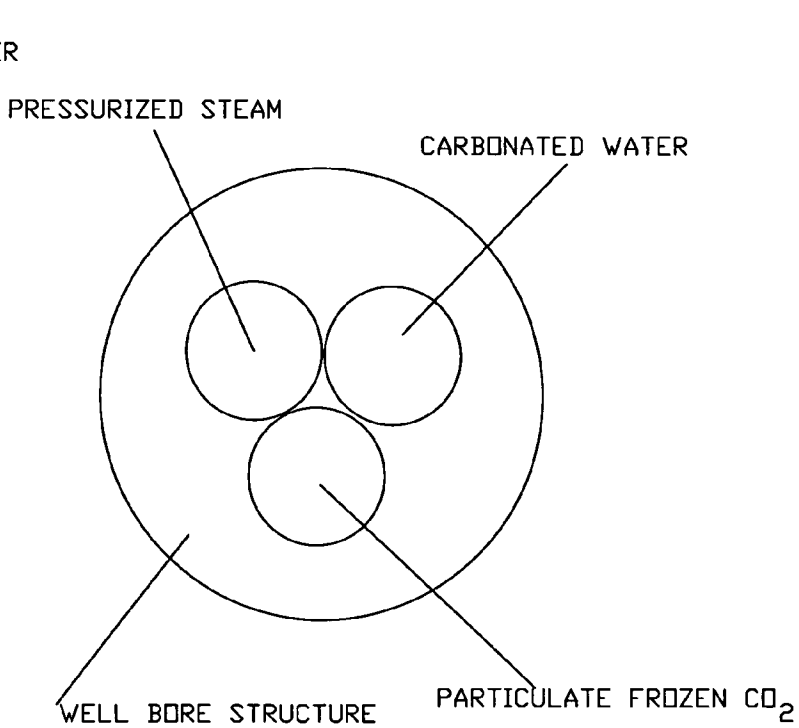
FIGS. 4*a* and 4*b* illustrate two types of insertion tubes.
Figure 4A:
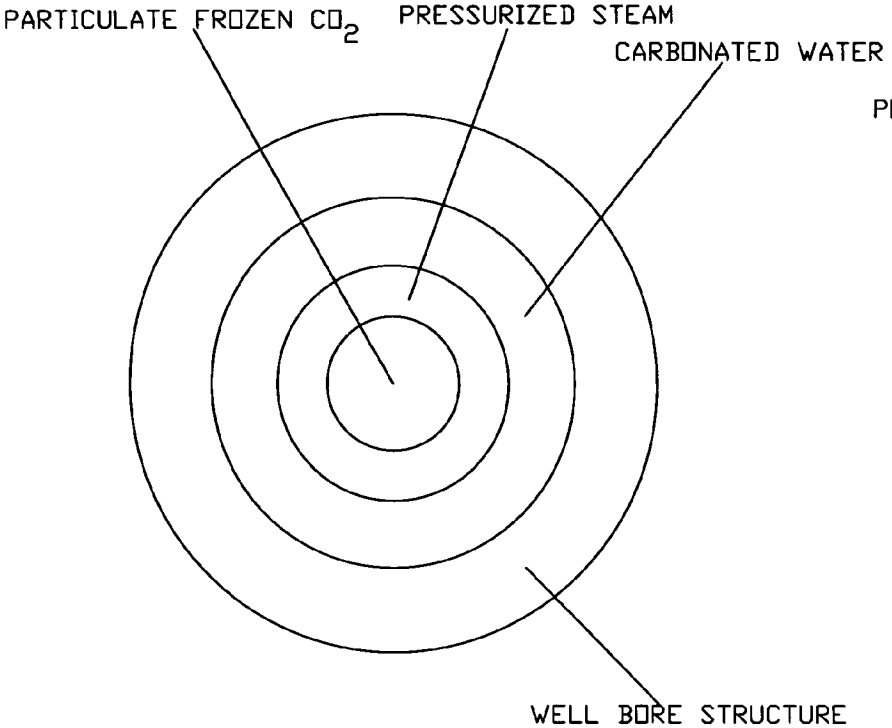

Pipe 45, in FIG. 3 may have several configurations and partitions for inserting the fracturing materials into the well. FIGS. 4*a* and 4*b* below, shows two possible configurations. Other configurations are possible to individually insert the fracturing materials in the order necessary to provide the fracturing.

The carbonated water, frozen $CO_2$, and steam are alternately inserted though valve 20*a*.

The system of FIG. 1 could be used to extract minerals other than gas and oil. In this configuration, there would be extreme fracturing to break up the mineral containing soil/rock in the structure. The mineral containing soil/rock would be vacuumed up out of the structure where the minerals could be separated from the soil/rock. This process would use a vacuum system similar to that used to mine minerals from the sea bottom. In this instance, the pressure system and release valves would not be used.

FIGS. 4*a* and 4*b* illustrate two types of insertion tubes. FIGS. 4*a* and 4*b* are cross sectional views taken at A-A in FIG. 3.

FIG. 4*a* shows concentric used to insert particulate frozen $CO_2$, pressurized steam and carbonated water and fracking sand as needed. The outer structure is the well bore structure into which the concentric tubes are inserted.

FIG. 4*b* shows parallel tubes into which pressurized steam, carbonated water and particulate frozen $CO_2$ are injected into the well bore structure.

These two configurations are examples for inducing the fracturing material. Other configurations may be used, for example some of the tubes may be used for more than one insertion path, different injection materials may be switched between the injection paths.

The valves 3, 20, 20*a*, 10*b* and 11*c* and tubes 2*a* and 2*b* in FIGS. 1, 2 and 3 may remain onsite for future use.

What is claimed:

1. A method of fracturing a formation around a well bore, to produce at least one of natural gas and oil;

running a tube extending downward into the well bore and into the horizontal region of the well bore, wherein the tube comprises peripheral openings in the horizontal region of the well bore;

injecting frozen $CO_2$ into the tube and releasing the frozen $CO_2$ into the well bore through the peripheral openings radially from the inner bore of the tube to the annulus between the tube and the sidewall of the well bore;

injecting pressurized steam into the tube and releasing the pressurized steam into the well bore through the peripheral openings radially from the inner bore of the tube to the annulus between the tube and the sidewall of the well bore.

2. The method according to claim 1, wherein the peripheral openings in the tube are spaced apart in progressively reduced spaces to maximize the insertion of the pressurized steam in equal portions along the length of the horizontal portion of the tube.

3. The method according to claim 1 wherein the frozen $CO_2$ is cooled below its freezing temperature to produce a snow like material; and injecting the pressurized steam after a sufficient amount of the frozen $CO_2$ is released into the well bore to create a catalytic reaction that heats and expands the frozen $CO_2$ causing the fracturing of the formation around the well bore.

4. The method according to claim 3 including the triggering of a sensor valve when a sufficient amount of the frozen $CO_2$ has been released into the well bore to close off the insertion of the frozen $CO_2$ and opening a second valve to allow the pressurized steam to be injected into the well bore to rapidly expand the frozen CO2.

5. The method according to claim 1 providing a system for freezing $CO_2$ for injecting into the well bore.

* * * * *